US008368324B2

(12) United States Patent
Lin et al.

(10) Patent No.: US 8,368,324 B2
(45) Date of Patent: Feb. 5, 2013

(54) DRIVING APPARATUS AND METHOD FOR ADJUSTING DRIVE VOLTAGE

(75) Inventors: Kai-Ping Lin, Miaoli (TW); Chun-Hsin Yang, Miaoli (TW); Wen-Cheng Shih, Miaoli (TW)

(73) Assignee: Fitipower Integrated Technology, Inc., Hsinchu (TW)

( * ) Notice: Subject to any disclaimer, the term of this patent is extended or adjusted under 35 U.S.C. 154(b) by 255 days.

(21) Appl. No.: 12/852,533

(22) Filed: Aug. 9, 2010

(65) Prior Publication Data

US 2011/0031898 A1 Feb. 10, 2011

(30) Foreign Application Priority Data

Aug. 10, 2009 (TW) ..... 98126708 A

(51) Int. Cl.

| | |
|---|---|
| ***H05B 37/00*** | (2006.01) |
| ***H05B 37/02*** | (2006.01) |
| ***H05B 39/00*** | (2006.01) |
| ***H05B 39/04*** | (2006.01) |
| ***H05B 41/00*** | (2006.01) |
| ***H05B 41/36*** | (2006.01) |
| ***G05F 1/00*** | (2006.01) |

(52) U.S. Cl. ..... 315/312; 315/291; 315/209 R; 323/282

(58) Field of Classification Search ..... 315/312, 315/209 R, 291, 224, 192
See application file for complete search history.

(56) References Cited

U.S. PATENT DOCUMENTS

| | | | | |
|---|---|---|---|---|
| 7,764,265 | B2 | 7/2010 | Ko | |
| 7,918,670 | B2 * | 4/2011 | Shmatovich et al. | 439/67 |
| 7,928,670 | B2 * | 4/2011 | Chen et al. | 315/308 |
| 7,999,487 | B2 * | 8/2011 | Szczeszynski | 315/291 |
| 8,044,609 | B2 * | 10/2011 | Liu | 315/291 |
| 2009/0128045 | A1 * | 5/2009 | Szczeszynski et al. | 315/185 R |
| 2010/0013412 | A1 * | 1/2010 | Archibald et al. | 315/294 |
| 2010/0164403 | A1 * | 7/2010 | Liu | 315/297 |
| 2010/0265271 | A1 * | 10/2010 | Chang et al. | 345/690 |
| 2011/0234122 | A1 * | 9/2011 | Yu et al. | 315/297 |
| 2011/0267375 | A1 * | 11/2011 | Yang et al. | 345/690 |
| 2011/0316447 | A1 * | 12/2011 | Liu | 315/297 |
| 2012/0001557 | A1 * | 1/2012 | Hagino et al. | 315/192 |
| 2012/0126712 | A1 * | 5/2012 | Kim | 315/187 |
| 2012/0139443 | A1 * | 6/2012 | Chu | 315/294 |

* cited by examiner

*Primary Examiner* — Shawki Ismail
*Assistant Examiner* — Dylan White
(74) *Attorney, Agent, or Firm* — Altis Law Group, Inc.

(57) ABSTRACT

A driving apparatus includes a voltage transforming unit and a detector. The driving apparatus is used for supplying a drive voltage to a load. The voltage transforming unit is used for transforming a direct current (DC) voltage to the drive voltage. The detector is connected to the load for detecting a forward voltage across the load to generate a detecting voltage; wherein the detector compares the detecting voltage with a first reference voltage. If the detecting voltage is smaller than the first reference voltage, the detector generates a first feedback signal; the voltage transforming unit increases the drive voltage according to the first feedback signal, the detecting voltage is defined by subtraction of the forward voltage from the drive voltage.

20 Claims, 2 Drawing Sheets

DRIVING APPARATUS AND METHOD FOR ADJUSTING DRIVE VOLTAGE

BACKGROUND

1. Technical Field

The disclosed embodiments relate to driving apparatuses; and particularly to a driving apparatus for driving a plurality of loads, such as light emitting diodes (LEDs) to emit light and a method for adjusting a drive voltage.

2. Description of Related Art

Light emitting diodes (LEDs) are widely used in various electronic devices, such as a backlight module of a liquid crystal display (LCD). A typical LED driving circuit includes several LED strings and several metal oxide semiconductor field effect transistors (MOSFETs) respectively connected to the LED strings, the LED string includes a number of LEDs connected in series. The LED strings are driven by a drive voltage from a voltage source, so that brightness of all the LED strings is the same.

However, in the manufacturing process, the resistance of each of the LEDs may be different. When the LEDs emit light, temperatures of the LEDs may vary, so that the resistance of each of the LEDs may also be different, resulting in different voltages across each of the LEDs. If the drive voltage is adjusted by decreasing it, some of the LED strings may not emit light. If the drive voltage is adjusted by increasing it, the MOSFETs may consume too much electric energy.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout two views.

DETAILED DESCRIPTION

Figure 1:
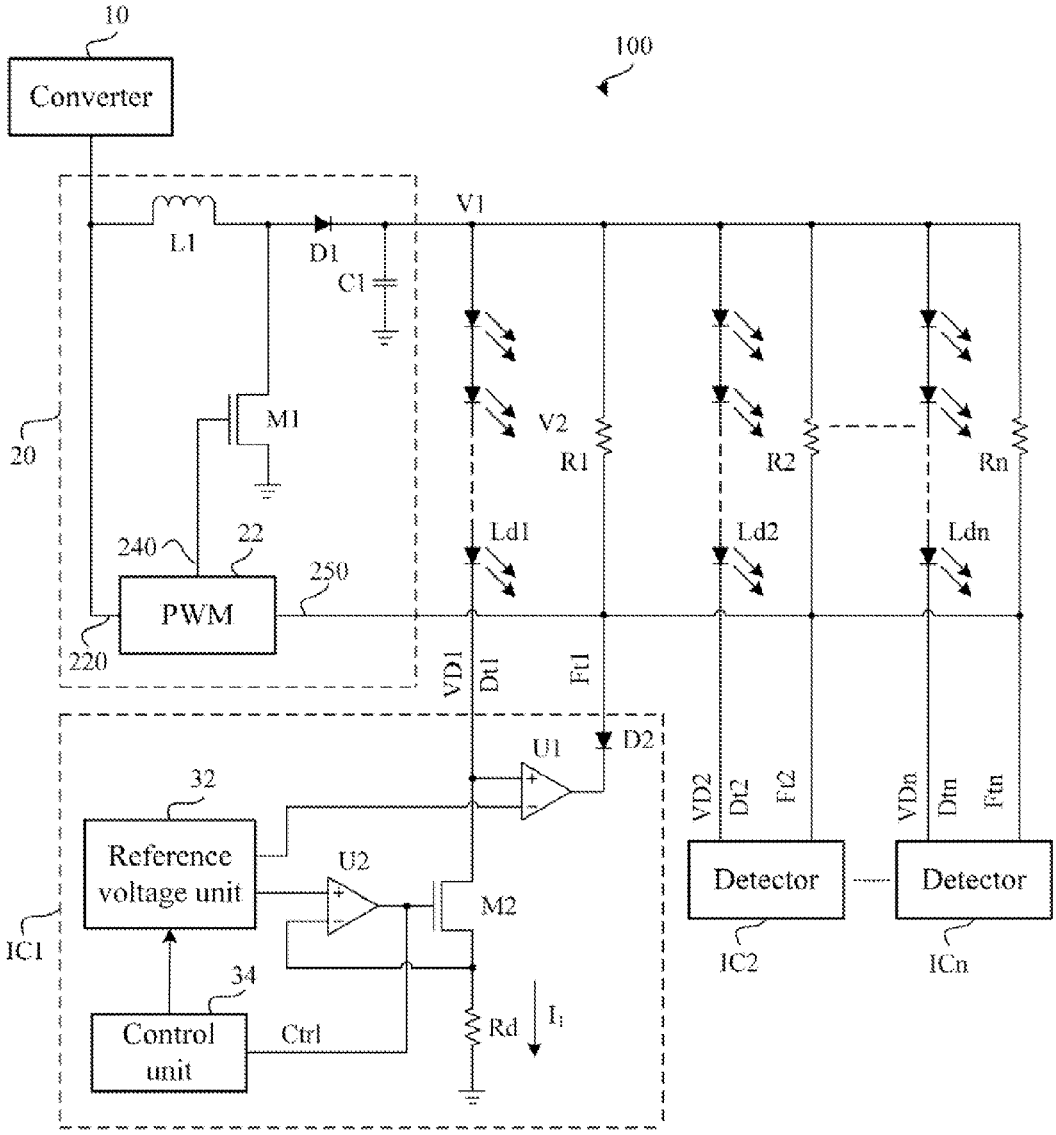
FIG. 1 is a block diagram of a driving apparatus in accordance with an exemplary embodiment.

Referring to FIG. 1, a driving apparatus 100 includes a converter 10, a voltage transforming unit 20, a plurality of loads Ld1, Ld2 . . . Ldn, a plurality of pull-up resistors R1, R2 . . . Rn, and a plurality of detectors IC1, IC2 . . . ICn. The detectors IC1, IC2 . . . ICn respectively include a plurality of detecting terminals Dt1, Dt2 . . . Dtn and a plurality of feedback terminals Ft1, Ft2 . . . Ftn. In this embodiment, each of the loads Ld1, Ld2 . . . . Ldn is a light emitting diode (LED) string, and the LED string includes a plurality of LEDs connected in series.

The converter 10 is used for converting an alternating current (AC) voltage to a direct current (DC) voltage.

The voltage transforming unit 20 is used for transforming the DC voltage to a drive voltage, and the drive voltage is supplied to the loads Ld1, Ld2 . . . Ldn. One end of each of the loads Ld1, Ld2 . . . Ldn is connected to the voltage transforming unit 20, the other end of each of the loads Ld1, Ld2 . . . Ldn is respectively connected to the detecting terminals Dt1, Dt2 . . . Dtn.

One end of each of the pull-up resistors R1, R2 . . . Rn is connected to the voltage transforming unit 20, the other end of each of the pull-up resistors R1, R2 . . . Rn is respectively connected to the feedback terminals Ft1, Ft2 . . . Ftn. In other embodiments, the pull-up resistors R1, R2 . . . Rn can be respectively integrated into the detectors IC1, IC2 . . . ICn.

The detectors IC1, IC2 . . . ICn are used for respectively detecting a forward voltage across each of the loads Ld1, Ld2 . . . Ldn, so as to respectively generate a plurality of detecting voltages VD1, VD2 . . . VDn, each of the detecting voltages VD1, VD2 . . . VDn is defined by subtraction of corresponding forward voltage from the drive voltage. A first reference voltage is preset in the detectors IC1, IC2 . . . ICn. The detectors IC1, IC2 . . . ICn respectively compare the detecting voltages VD1, VD2 . . . VDn with the first reference voltage to generate a feedback signal, the voltage transforming unit 20 adjusts the drive voltage according to the feedback signal. In detail, if one of the detecting voltages VD1, VD2 . . . VDn is smaller than the first reference voltage, the corresponding detector generates a feedback signal being in the low level. The voltage transforming unit 20 increases the drive voltage according to the feedback signal being in the low level.

If the drive voltage is increased, the detecting voltages VD1, VD2 . . . VDn are also increased. The detectors IC1, IC2 . . . ICn respectively compare the increased detecting voltages VD1, VD2 . . . VDn with the first reference voltage. If one of the increased detecting voltages VD1, VD2 . . . VDn is larger than the first reference voltage, the corresponding detector generates a feedback signal being in the high level. The voltage transforming unit 20 decreases the drive voltage according to the feedback signal being in the high level.

In detail, the voltage transforming unit 20 includes a pulse width modulator (PWM) 22, a first metal oxide semiconductor field effect transistor (MOSFET) M1, an inductor L1, a first diode D1, and a capacitor C1. The PWM 22 includes an input pin 220, an output pin 240, and a feedback pin 250. The input pin 220 is connected to the converter 10, and is used for receiving the DC voltage to be powered on, so that the output pin 240 outputs a pulse voltage whose duty cycle is adjustable. The feedback pin 250 is connected to the feedback terminals Ft1, Ft2 . . . Ftn. One end of the inductor L1 is connected to the converter 10, the other end of the inductor L1 is connected to an anode of the first diode D1, a cathode of the first diode D1 is grounded through the capacitor C1. The cathode of the first diode D1 is also connected to the loads Ld1, Ld2 . . . Ldn. A gate of the first MOSFET M1 is connected to the output pin 240, a drain of the first MOSFET M1 is connected between the inductor L1 and the anode of the first diode D1, and a source of the first MOSFET M1 is grounded. In this embodiment, the first MOSFET M1 is an N type MOSFET.

Hereinafter, the detail circuit of the detector IC1 is illustrated. Each of the detectors IC2, IC3 . . . ICn is the same as the detector IC1. The detector IC1 includes a reference voltage unit 32, a control unit 34, a pull-down resistor Rd, a second MOSFET M2, a first operational amplifier U1, a second operational amplifier U2, and a second diode D2. In other embodiments, the second diode D2 is not integrated in the detector IC1. The reference voltage unit 32 is used for providing a first reference voltage to an inverting input terminal of the first operational amplifier U1, and a second reference voltage to a non-inverting input terminal of the second operational amplifier U2.

One end of the pull-down resistor Rd is connected to the inverting input terminal of the second operational amplifier U2 and a source of the second MOSFET M2, the other end of the pull-down resistor Rd is grounded. An output terminal of the second operational amplifier U2 is connected to a gate of the second MOSFET M2. A drain of the second MOSFET M2 is connected to one end of the load Ld1 and a non-inverting input terminal of the first operational amplifier U1, the other end of the load Ld1 is connected to the voltage transforming unit 20. An output terminal of the first operational amplifier U1 is connected to a cathode of the second diode D2, an anode of the second diode D2 is connected to one end of the pull-up resistor R1 and the feedback pin 250 of the PWM 22, the other end of the pull-up resistor R1 is connected to the voltage transforming unit 20. In this embodiment, the second MOSFET M2 is an N type MOSFET.

The control unit 34 is connected to the reference voltage unit 32 and the gate of the second MOSFET M2. The control unit 34 is used for enabling or disabling the reference voltage unit 32, if the reference voltage unit 32 is disabled, the reference voltage unit 32 stops providing the first reference voltage and the second reference voltage. The control unit 34 is further used for enabling or disabling the second MOSFET M2, if the second MOSFET M2 is disabled, no current will flow through the pull-down resistor Rd.

The principal of the driving apparatus 100 is illustrated as follows: when the voltage transforming unit 20 outputs the drive voltage V1 to the loads Ld1, Ld2 . . . Ldn, the forward voltage across the load Ld1 is defined as V2, thus the detecting voltage VD1 of the detecting terminal Dt1 is calculated as VD1=V1−V2. When the forward voltage V2 is increased to cause the detecting voltage VD1 to be lower than the first reference voltage, the first operational amplifier U1 outputs a low level voltage, thus the feedback pin 250 of the PWM 22 is also a low level voltage, and the output pin 240 of the PWM 22 outputs the pulse voltage whose duty cycle is increased. Therefore, turn-on time of the first COMS is increased, magnetic energy stored by the inductor L1 is increased, and the drive voltage V1 is increased.

When the drive voltage V1 is increased, the detecting voltage VD1 is also increased. If the detecting voltage VD1 is larger than the first reference voltage, the first operational amplifier U1 outputs a high level voltage, the feedback pin 250 of the PWM 22 is also a high level voltage, thus the duty cycle of the pulse voltage is decreased, and magnetic energy stored by the inductor L1 is decreased, the drive voltage V1 is decreased. The drive voltage V1 is adjusted by the voltage transforming unit 20, eventually the detecting voltage VD1 is equal to the first reference voltage Vref1, and the forward voltage V2 of the LED string Ld1 is calculated as V2=V1−Vref1, thus the forward voltage V2 is constant.

Furthermore, because the inverting input terminal of the second operational amplifier U2 is equal to the second reference voltage Vref2, a current I1 flowing through the pull-down resistor Rd is calculated as I1=Vref2/Rd, because the second reference voltage Vref2 is constant, therefore the current I1 flowing through the loads Ld1, Ld2 . . . Ldn is also constant.

Figure 2:
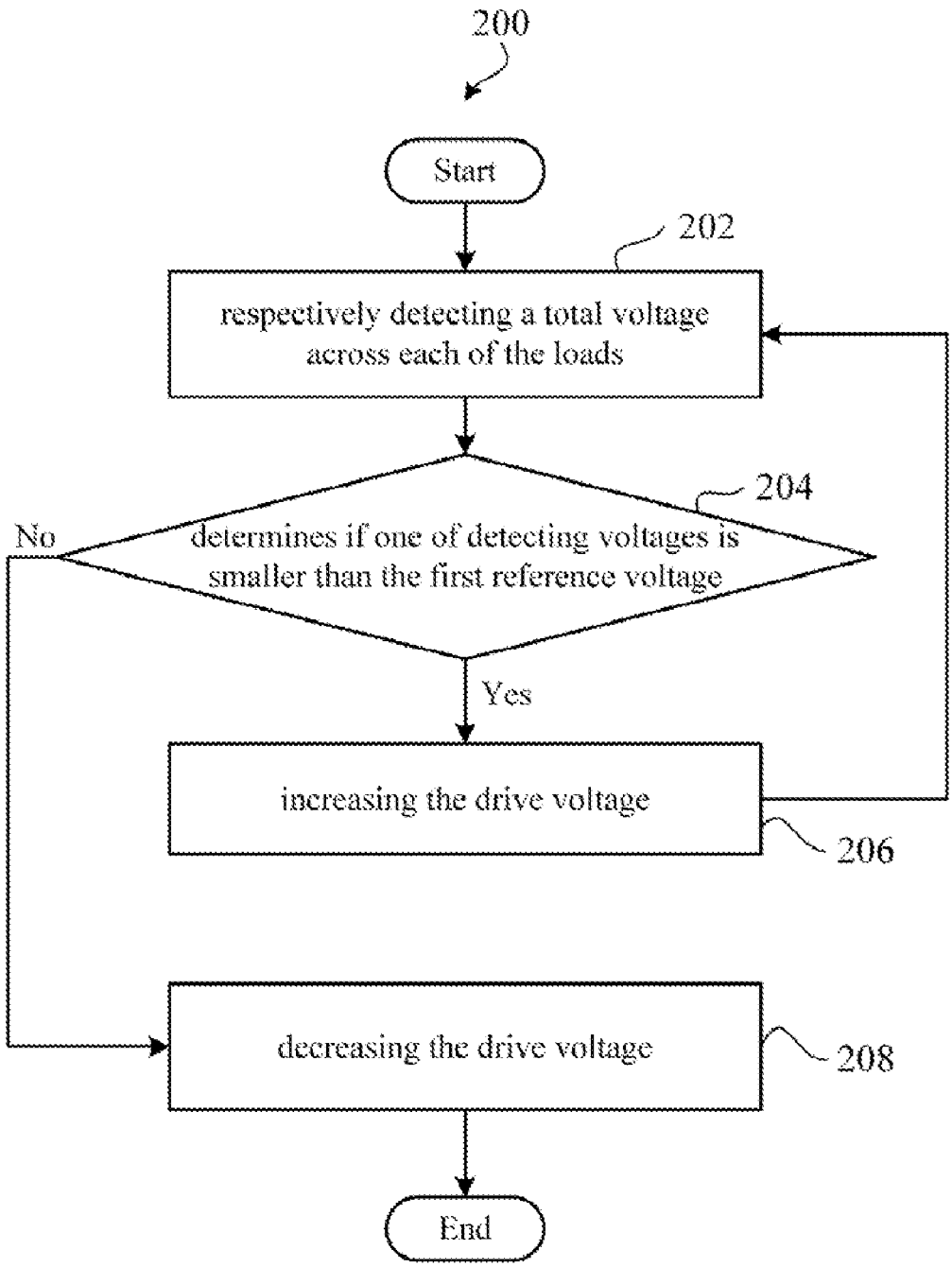
FIG. 2 illustrates a method for adjusting a drive voltage being supplied to the loads in accordance with the exemplary embodiment.

Referring to FIG. 2, a method 200 for adjusting a drive voltage supplied to a plurality of loads Ld1, Ld2 . . . Ldn is illustrated, the method 200 includes the following steps:

Step 202, detecting a forward voltage across each of the loads Ld1, Ld2 . . . Ldn to generate a plurality of detecting voltages VD1, VD2 . . . VDn;

Step 204, respectively determining if one of detecting voltages VD1, VD2 . . . VDn is smaller than a first reference voltage by respectively comparing the detecting voltages VD1, VD2 . . . VDn with the first reference voltage, each of the detecting voltages VD1, VD2 . . . VDn is defined by subtraction of corresponding forward voltage from the drive voltage;

Step 206, increasing the drive voltage if one of detecting voltages VD1, VD2 . . . VDn is smaller than the first reference voltage; the procedure goes to Step 202;

Step 208, decreasing the drive voltage if one of detecting voltages VD1, VD2 . . . VDn is larger than the first reference voltage; the procedure goes to END;

Further alternative embodiments will become apparent to those skilled in the art without departing from the spirit and scope of what is claimed. Accordingly, the present invention should be deemed not to be limited to the above detailed description, but rather only by the claims that follow and equivalents thereof.

What is claimed is:

1. A driving apparatus for supplying a drive voltage to a plurality of loads, the driving apparatus comprising:

a voltage transforming unit for transforming a direct current (DC) voltage to the drive voltage; and a plurality of detectors respectively connected to the loads for respectively detecting a forward voltage across each of the loads to generate a plurality of detecting voltages and respectively comparing the detecting voltages with a first reference voltage to generate a feedback signal; wherein each of the detecting voltages is defined by subtraction of corresponding forward voltage from the drive voltage which is performed by each detector, each detector performs the subtraction function, the voltage transforming unit adjusts the drive voltage according to the feedback signal.

2. The driving apparatus of claim 1, wherein if one of the detecting voltage is smaller than the first reference voltage, the corresponding detector generates the feedback signal being in the low level; the voltage transforming unit increases the drive voltage according to the feedback signal being in the low level.

3. The driving apparatus of claim 1, wherein if one of the detecting voltage is larger than the first reference voltage, the corresponding detector generates the feedback signal being in the high level, the voltage transforming unit decreases the drive voltage according to the feedback signal being in the high level.

4. The driving apparatus of claim 1, wherein the load is a light emitting diode (LED) string, the LED string comprises a plurality of LEDs connected in series.

5. The driving apparatus of claim 1, wherein the voltage transforming unit comprises a pulse width modulator (PWM), a first metal oxide semiconductor field effect transistor (MOSFET), an inductor, a first diode, and a capacitor, the PWM includes an input pin, an output pin, and a feedback pin, the input pin is used for receiving the DC voltage, the output pin is used for outputting a pulse voltage whose duty cycle is adjustable, the feedback pin is connected to the detectors, one end of the inductor is connected to the converter, the other end of the inductor is connected to an anode of the first diode, a cathode of the first diode is grounded through the capacitor, the cathode of the first diode is also connected to each of the loads, a gate of the first MOSFET is connected to the output pin, a drain of the first MOSFET is connected between the inductor and the anode of the first diode, and a source of the first MOSFET is grounded.

6. The driving apparatus of claim 5, wherein the driving apparatus further comprises a plurality of pull-up resistors, one end of each of the pull-up resistors are connected to the voltage transforming unit, the other end of each of the pull-up resistors are respectively connected to the detectors.

7. The driving apparatus of claim 6, wherein the detector comprises a reference voltage unit, a first operational amplifier, a second operational amplifier, a pull-down resistor, a second MOSFET, and a second diode, the reference voltage unit is used for providing a first reference voltage to an inverting input terminal of the first operational amplifier and a second reference voltage to a non-inverting input terminal of the second operational amplifier, one end of the pull-down resistor is connected to an inverting input terminal of the second operational amplifier and a source of the second MOSFET, the other end of the pull-down resistor is grounded, an output terminal of the second operational amplifier is connected to a gate of the second MOSFET, a drain of the second MOSFET is connected to one end of the load and a non-inverting input terminal of the first operational amplifier, the other end of the load is connected to the voltage transforming unit, an output terminal of the first operational amplifier is connected to a cathode of the second diode, an anode of the second diode is connected to the pull-up resistor and the feedback pin of the PWM.

8. The driving apparatus of claim 7, wherein the detector further comprises a control unit, the control unit is connected to the reference voltage unit and the gate of the second MOSFET, the control unit is used for enabling or disabling the reference voltage unit and the second MOSFET.

9. The driving apparatus of claim 1, wherein the driving apparatus comprises a second diode, the detector comprises a reference voltage unit, a first operational amplifier, a second operational amplifier, a pull-down resistor, and a second MOSFET, the reference voltage unit is used for providing a first reference voltage to an inverting input terminal of the first operational amplifier, and a second reference voltage to a non-inverting input terminal of the second operational amplifier, one end of the pull-down resistor is connected to the inverting input terminal of the second operational amplifier and a source of the second MOSFET, the other end of the pull-down resistor is grounded, an output terminal of the second operational amplifier is connected to a gate of the second MOSFET, a drain of the second MOSFET is connected to one end of the load and a non-inverting input terminal of the first operational amplifier, the other end of the load is connected to the voltage transforming unit, an output terminal of the first operational amplifier is connected to a cathode of the second diode, an anode of the second diode is connected to one end of the pull-up resistor and the feedback pin of the PWM, the other end of the pull-up resistor is connected to the voltage transforming unit.

10. A driving apparatus for supplying a drive voltage to a load, the driving apparatus comprising:

a voltage transforming unit for transforming a direct current (DC) voltage to the drive voltage; and a detector connected to the load for detecting a forward voltage across the load to generate a detecting voltage; wherein the detecting voltage is defined by subtraction of the forward voltage from the drive voltage, the detector performs the subtraction function; the detector compares the detecting voltage with a first reference voltage to generate a feedback signal; the voltage transforming unit adjusts the drive voltage according to the feedback signal.

11. The driving apparatus of claim 10, wherein if the detecting voltage is smaller than the first reference voltage, the detector generates the feedback signal being in the low level; the voltage transforming unit increases the drive voltage according to the feedback signal being in the low level.

12. The driving apparatus of claim 10, wherein if the detecting voltage is larger than the first reference voltage, the detector generates the feedback signal being in the high level, the voltage transforming unit decreases the drive voltage according to the feedback signal being in the high level.

13. The driving apparatus of claim 10, wherein the voltage transforming unit comprises a pulse width modulator (PWM), a first metal oxide semiconductor field effect transistor (MOSFET), an inductor, a first diode, and a capacitor, the PWM includes an input pin, an output pin, and a feedback pin, the input pin is used for receiving the DC voltage, the output pin is used for outputting a pulse voltage whose duty cycle is adjustable, the feedback pin is connected to each of the detectors, one end of the inductor is connected to the converter, the other end of the inductor is connected to an anode of the first diode, a cathode of the first diode is grounded through the capacitor, the cathode of the first diode is also connected to each of the loads, a gate of the first MOSFET is connected to the output pin, a drain of the first MOSFET is connected between the inductor and the anode of the first diode, and a source of the first MOSFET is grounded.

14. The driving apparatus of claim 13, wherein the driving apparatus further comprises a pull-up resistor, one end of the pull-up resistor is connected to the voltage transforming unit, the other end of the pull-up resistor is connected to the detector.

15. The driving apparatus of claim 14, wherein the detector comprises a reference voltage unit, a first operational amplifier, a second operational amplifier, a pull-down resistor, a second MOSFET, and a second diode, the reference voltage unit is used for providing a first reference voltage to an inverting input terminal of the first operational amplifier and a second reference voltage to a non-inverting input terminal of the second operational amplifier, one end of the pull-down resistor is connected to the inverting input terminal of the second operational amplifier and a source of the second MOSFET, the other end of the pull-down resistor is grounded, an output terminal of the second operational amplifier is connected to a gate of the second MOSFET, a drain of the second MOSFET is connected to one end of the load and a non-inverting input terminal of the first operational amplifier, the other end of the load is connected to the voltage transforming unit, an output terminal of the first operational amplifier is connected to a cathode of the second diode, an anode of the second diode is connected to one end of the pull-up resistor and the feedback pin of the PWM, the other end of the pull-up resistor is connected to the voltage transforming unit.

16. The driving apparatus of claim 15, wherein the detector further comprises a control unit, the control unit is connected to the reference voltage unit and the gate of the second MOSFET, the control unit is used for enabling or disabling the reference voltage unit and the second MOSFET.

17. The driving apparatus of claim 14, wherein the driving apparatus comprises a second diode, the detector comprises a reference voltage unit, a first operational amplifier, a second operational amplifier, a pull-down resistor, and a second MOSFET, the reference voltage unit is used for providing a first reference voltage to an inverting input terminal of the first operational amplifier, and a second reference voltage to a non-inverting input terminal of the second operational amplifier, one end of the pull-down resistor is connected to the inverting input terminal of the second operational amplifier and a source of the second MOSFET, the other end of the pull-down resistor is grounded, an output terminal of the second operational amplifier is connected to a gate of the second MOSFET, a drain of the second MOSFET is connected to one end of the load and a non-inverting input terminal of the first operational amplifier, the other end of the load is connected to the voltage transforming unit, an output terminal of the first operational amplifier is connected to a cathode of the second diode, an anode of the second diode is connected to one end of the pull-up resistor and the feedback pin of the PWM, the other end of the pull-up resistor is connected to the voltage transforming unit.

18. A method for adjusting a drive voltage supplied to a plurality of loads, the method comprising:

respectively detecting a forward voltage across each of the loads through a plurality of detector to generate a plurality of detecting voltages;

determining if one of detecting voltages is smaller than the first reference voltage by respectively comparing the detecting voltages with a first reference voltage to generate a feedback signal, wherein each of the detecting voltages is defined by subtraction of corresponding forward voltage from the drive voltage, each detector performs the subtraction function;

adjusting the drive voltage according to the feedback signal.

19. The method of claim 18, further comprising:

increasing the drive voltage if one of detecting voltages is smaller than the first reference voltage;

decreasing the drive voltage if one of detecting voltages is larger than the first reference voltage.

20. The method of claim 18, wherein the load is a light emitting diode (LED) string, the LED string comprises a plurality of LEDs connected in series.

* * * * *